United States Patent [19]

Moore

[11] 4,131,405

[45] Dec. 26, 1978

[54] APPARATUS FOR PRODUCING STRUCTURAL PANELS

[76] Inventor: Richard L. Moore, 764 Humboldt St., Denver, Colo. 80218

[21] Appl. No.: 678,312

[22] Filed: Apr. 19, 1976

Related U.S. Application Data

[63] Continuation-in-part of Ser. No. 420,390, Nov. 30, 1973, abandoned.

[51] Int. Cl.[2] ..... B28B 7/02; B28B 7/22; B28B 7/26

[52] U.S. Cl. ..... 425/143; 249/16; 249/120; 249/156; 249/158; 249/165; 249/170 425/446

[58] Field of Search ..... 249/3-7, 249/15, 16, 112, 155-159, 168, 170, 172, 120, 165; 425/143, 404, 446; 34/224, 232; 432/225, 227; 248/354 P

[56] References Cited

U.S. PATENT DOCUMENTS

| | | | |
|---|---|---|---|
| 1,381,663 | 6/1921 | Roeder | 248/354 P |
| 1,389,817 | 9/1921 | Deal | 249/156 |
| 1,444,179 | 2/1923 | Fiala | 249/158 |
| 1,495,305 | 5/1924 | Heltzel | 249/6 |
| 1,538,600 | 5/1925 | Amdursky | 425/143 |
| 2,170,936 | 8/1939 | Baron | 425/404 |
| 2,793,416 | 5/1957 | Yearling | 249/7 |
| 3,002,322 | 10/1961 | Dorsett | 249/16 |
| 3,385,552 | 5/1968 | Von Drasek et al. | 249/4 |
| 3,475,529 | 10/1969 | Lacy | 425/111 |
| 3,687,412 | 8/1972 | Vaughan et al. | 249/158 |

*Primary Examiner*—Francis S. Husar
*Assistant Examiner*—John McQuade
*Attorney, Agent, or Firm*—John E. Reilly; James R. Young

[57] ABSTRACT

An apparatus for producing a structural panel of prestressed and reinforced cementitious material includes a hinged box form or, alternatively, a reusable adjustable metal form having telescopic, slidably adjustable brace members, said forms also having stackable modules to provide selectively variable heights of the form walls, a resilient mold, side form members dividing the adjustable forms into a plurality of individual panel forms, a header for dividing each individual panel form into a shallow and a deep portion and which serves as a nailing strip in the finished panel, and steam curing apparatus.

4 Claims, 16 Drawing Figures

APPARATUS FOR PRODUCING STRUCTURAL PANELS

BACKGROUND OF THE INVENTION

1. Field of the Invention

This application is a continuation-in-part of application Ser. No. 420,390, filed Nov. 30, 1973, now abandoned, for STRUCTURAL PANEL AND METHOD OF PRODUCING SUCH PANELS, by Richard L. Moore.

The present invention relates generally to reusable and adjustable forming apparatus for forming structural concrete members particularly, lightweight, economical structural members of prefabricated and reinforced cementitious material such as concrete, which can be quickly and easily adapted and adjusted for custom fabricating a relatively large number of precast concrete panels of different sizes.

2. Description of the Prior Art

Background of the Invention

Concrete has been used for many years to construct walls, columns, beams, floors, and overheads of various dimensions and sizes. Originally, the desired concrete configuration was obtained by erecting forms in the shape desired at the location where the concrete was to be situated. Although this method is still widely used, recent years have witnessed the advent of precast concrete panels which are formed and poured at some distant site, allowed to cure, then transported to the building site and erected. This method has proven to be economical, particularly where a relatively large number of identical panels are required.

Numerous structural members of cementitious material have heretofore been described and/or utilized. Generally, these may be divided into two categories. The first category includes prestressed units having load-bearing functions as beams or sleepers, etc. The second category includes cast wall panels which, when used in conjunction with prestressed units, serve as curtain walls.

Prestressed concrete members, such as those mentioned in, for example, U.S. Pat. Nos. 2,394,227, 2,863,206, 3,202,94 and 3,567,816, are typically produced for use as load-bearing members. Accordingly, structures utilizing prestressed members are formed, in the instance of buildings, not unlike conventional steel and masonry construction wherein a skeleton of prestressed beams is erected and non-load-bearing vertical curtain walls are provided to fill in the openings between the load-bearing members. Thus prestressed members are used primarily for beam and floor members which are load-bearing as opposed to the enclosing function of the non-load-bearing vertical wall.

On the other hand, concrete panels of ordinary or reinforced, as opposed to prestressed, concrete are widely discussed and modestly used. For example, U.S. Pat. Nos. 2,620,51, 3,002,322, 3,503,165, 3,507,084 and 3,605,353, all disclose and discuss concrete panels having the advantage of excess weight and/or the use of excess quantities of material in order that the panels have sufficient strength to support the weight of the panel during handling. One of the reasons for the excess as to weight and material goes to the nature of concrete which is extremely strong in compression but displays a marked tendency to fail under tension in the shear mode. Accordingly, though reinforced concrete intercepts the tension and shear forces in the reinforcing bars, rods or mesh and distributes these forces throughout the panel, a relatively substantial thickness of concrete is required to properly encase the reinforcing materials and, preferably, to provide a strong three-dimensional configuration of reinforcing structure. Thus, a relatively thick panel of reinforcing concrete is needed to be self-supporting during transport and handling.

While the nature of concrete is enhanced by prestressing wherein substantial compressive loads are induced by, typically, casting the concrete around tensioned cables and then releasing the tension to induce compressive stresses in the concrete. Generally, members having substantially constant cross-sections have been utilized in conjunction with prestressing to withstand the rather large compressive forces. Accordingly, prestressed members are generally rather massive beam or span members. Also, prestressing required rather substantial plant investment for equipment and, thus, has been utilized to produce members of substantial size to fully employ the equipment.

Even though forming, pouring and curing the concrete slabs at a prefabrication site has proved to be economical, particularly in larger building construction, there is still a significant labor and material expense required for forming at the prefabrication site, and there is always a significant amount of wasted materials such as wood forms which either cannot be used again at all or the reuse of which is limited by the deterioration, cutting, and breakage when the forms are constructed, or when they are dismantled and torn away from the concrete. This invention is directed to new and improved apparatus for setting forms for the prefabrication of any desired size of concrete panels and which can be easily removed, reset, and reused an unlimited number of times and for unlimited variations in different sized concrete panels in successive custom jobs. Yet, there is substantially less waste in both time and material, and the apparatus is quite conductive to mass production of a large number of precast panels in one setting. The apparatus is also very conductive to the prefabrication of custom-sized prestressed concrete panels.

SUMMARY OF THE INVENTION

The present invention, which provides a heretofore unavailable improvement over previous apparatus for casting concrete panels, which are of predetermined thickness and both reinforced and prestressed. The panel is produced by a particularly unique apparatus for providng a form, or preferably a series of forms, on a casting table with continuous tension members or cables arranged therethrough. A header member, which serves as an integral member of the panel into which floor joists can be nailed, is positioned across the form and substantially parallel to the cables. The form is thus divided into a shallower portion on one side of the header and a deeper portion by an amount substantially equal to the height of the header on the opposite side of the header. The shallower portion is between about 30% to 80% of the thickness of the deeper portion. Cementitious material can then poured onto a mold, such as a flexible mat, placed in the bottom of the form and configured to produce an architectural finish, such as textured or brick finish on the bottom side, or exterior face, of the panel. The flexible mode also provides for a convenient release of the panel from the casting table. Furring strips or another mold can be placed in the exposed surface of the unset cementitious material to form yet another nailing surface or provide an architectural finish, respectively.

After curing, preferably with the aid of a covering and steam, the cables are released and the panel removed. Since the compression forces are parallel to the discontinuity in wall thickness, destructive unsymmetrical forces between the thicker and thinner portions of the panel are avoided. By both prestressing and reinforcing rather thin sections can be utilized thereby avoiding the massiveness generally associated with such panels and required to provide support during maneuvering and erection of the massive panels. Also, the panel, though lightweight, has a load-bearing capacity and need not be utilized with other structures in most instances.

The preferred form of this invention includes adjustable steel forms for the opposite ends of prefabricated concrete panels which can be adjusted for various heights and depths of concrete panels as required by a designer. These forms are adapted to be set on a concrete casting table, adjusted to any specific dimensions as required and secured in place for pouring concrete. Each form member for the bottom of the panel includes means for securing the form in an immovable, fixed position on the concrete casting table, preferably a stake and socket arrangement. Additional forms can be placed in an end-to-end relationship with the first form along the length of the pouring bed, securely attached together in a straight line and staked to the concrete bed in an immovable fashion. Any number of these form members can be secured together in this fashion to acquire the length of the form required for the number of panels to be fabricated.

The steel forms for the upper end of the panels are the same as the forms used and described for the bottom end of the panels with the addition of an adaptor for connection of adjustable form braces. The forms on the upper end of the panel are not secured by stakes to holes in the casting table, but are retained in place by the adjustable braces. Thus the top form can be secured in place for any height dimension for the precast concrete panels that may be specified by the designer.

The movable form members for the upper end also include the stake receiving appendages or sockets; however these appendages are used to secure additional form members on top of the first form member when a thicker panel is desired.

Once the forms for the bottom and top of the panels are set in place at the dimensions desired, the sides of the panels are formed with wood in a conventional manner, depending upon the cross-sectional configuration desired for the particular concrete panels to be formed. Polymer texturing mats or flexible molds can also be placed in the forms for fabricating a desired textured finish as described in the parent application. Prestressing cables can then be strung through the forms through holes in the wood side forms and attached at one end of the casting table, then prestressed at the other end of the casting table by common prestressing machinery and fastened. If required by the design of the panels, steel reinforcing bars can be laid directly on the tensioned prestressing cables without the necessity of using chairs to hold them off the surface of the casting table or the flexible mold. Concrete is then poured into the series of forms along the length of the casting table, screeded, leveled and troweled. An insulated cover is placed over the entire casting table and steam is introduced over the concrete and under the cover to aid in curing the concrete. The steam can be controlled over the entire length of the casting table by the use of temperature sensors which are connected to automated valve controls capable of reducing or increasing the amount of steam being injected at any location along the casting table.

Accordingly, it is an object of the present invention to provide a new and useful apparatus for producing panels of cementitious material having an integrally patterned surface formed during the casting operation.

Yet another object of the present invention is to provide a new and improved reusable apparatus for forming light-weight panels of cementitious material which and economically utilizes casting equipment and forming apparatus.

It is a further object of the present invention to provide forms which can be immovably secured to a casting table and set at any desired distance apart for prefabricating concrete panels of any desired height.

It is still further an object of this invention to provide for forms which can be stacked one member on top of another and secured to a casting table for the prefabrication of concrete panels of any desired thickness.

It is also an object of this invention to provide steel form members which can be set and used for pouring and curing any number of subsequent prefabricated panels of any desired dimension with no waste or deterioration when they are reused.

These and other objects, features, advantages and capabilities of the present invention will become more apparent as the description proceeds taken in conjunction with the accompanying drawings, in which:

DETAILED DESCRIPTION OF THE PREFERRED EMBODIMENT

Figure 1:
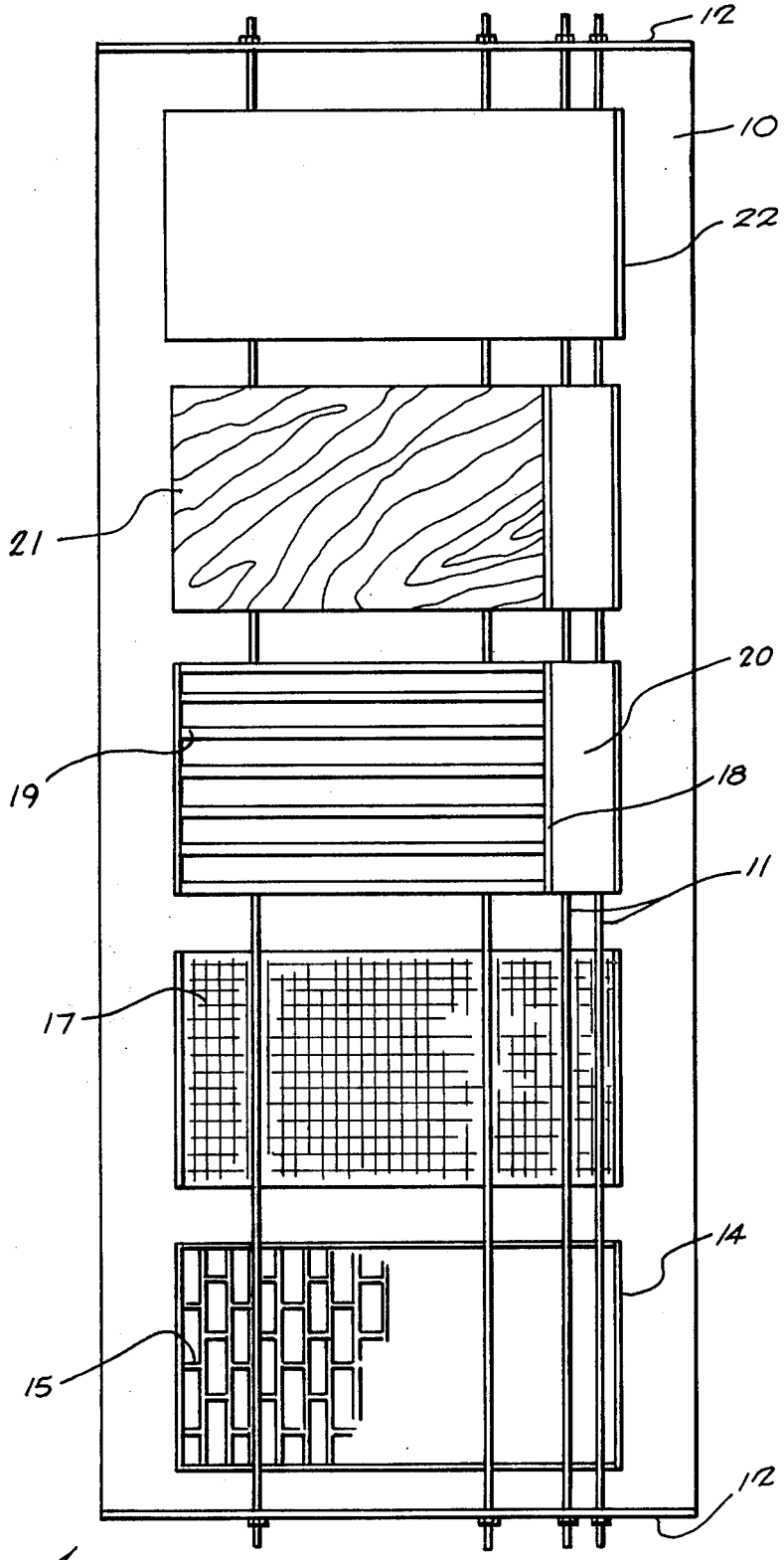
FIG. 1 is a simplified top plan view of one embodiment of the casting apparatus and forms of the instant invention.

Turning now to the drawings, wherein like components are designated by like reference numerals throughout the various FIGURES, an apparatus for producing the panels according to the instant invention as well as panels in various stages of the production process, are illustrated in FIG. 1 wherein casting table 10 is shown with prestressed members 11, such as tensioned rods or cables, positioned an appropriate distance above the table 10 by means of stresses induced in the members 11 by tensioning means 12. Tension can be generated by jacks, screw members or other means.

Several box-like forms 14 are shown supported on casting table 10 with the tensioned members 11 extending therethrough, and a flexible mold 15 is positioned on the casting table 10 within forms 14 as shown. Reinforcement members 17 are also positioned within form 14 prior to the pouring of cementitious material into form 14. Form 14 is divided into shallow and deep sections by a header 18 in such a manner as to divide form 14 in a direction parallel to tensioning members 11. Thus, when the cementitious material is poured within form 14, panel 20 is formed having a thinner wall portion and a thicker beam portion with the reinforcement members 17 and tensioning prestressed members 11 embedded within the cementitious material. Furring strips 19 are then optionally embedded in the cementitious material prior to setting thereby integrally including furring strips 19 and header 18 as part of panel 20. Alterntively, a flexible mold similar to or identical to flexible mold 15 utilized on the underside of panel 20 may also be employed to form the upper surface of panel 20. A relatively heavy surface such as wood sheet 21 is then laid upon the thinner portion of panel 20 to properly embed and level either furring strips 19 or flexible mold 15, as the case may be.

In order to expedite and optimize curing of the cementitious material of panel 20, mold 15 and the cementitious materials are encased in a spaced-apart and insulating cover 22. Steam is provided an regulated to maintain an optimum curing temperature for the optimum curing time to obtain maximum strength in the minumum amount of time.

Figure 2:
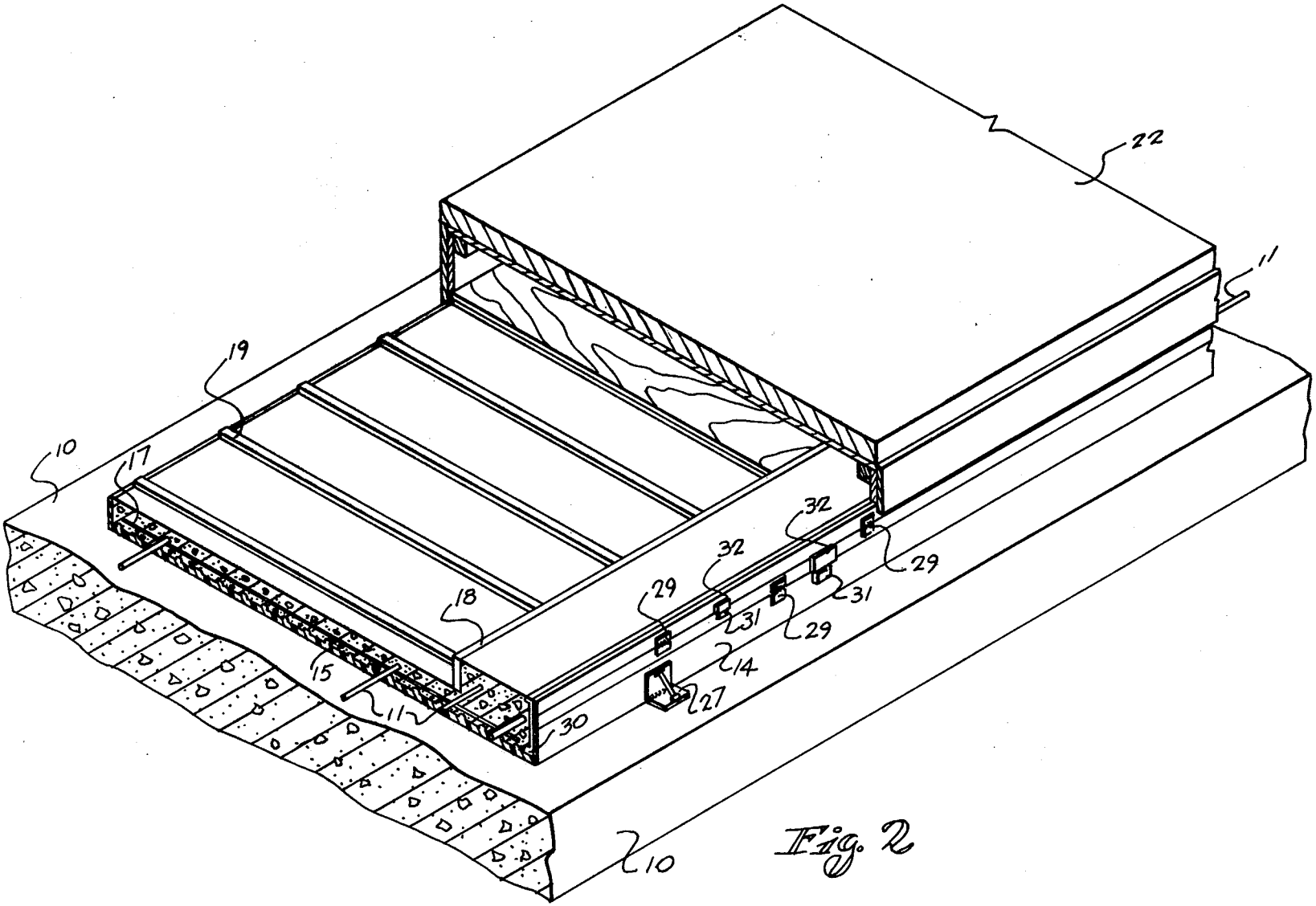
FIG. 2 is a partially sectioned perspective view of a completed panel in place on the casting table with accompanying forms and curing mechanism.
Figure 4:
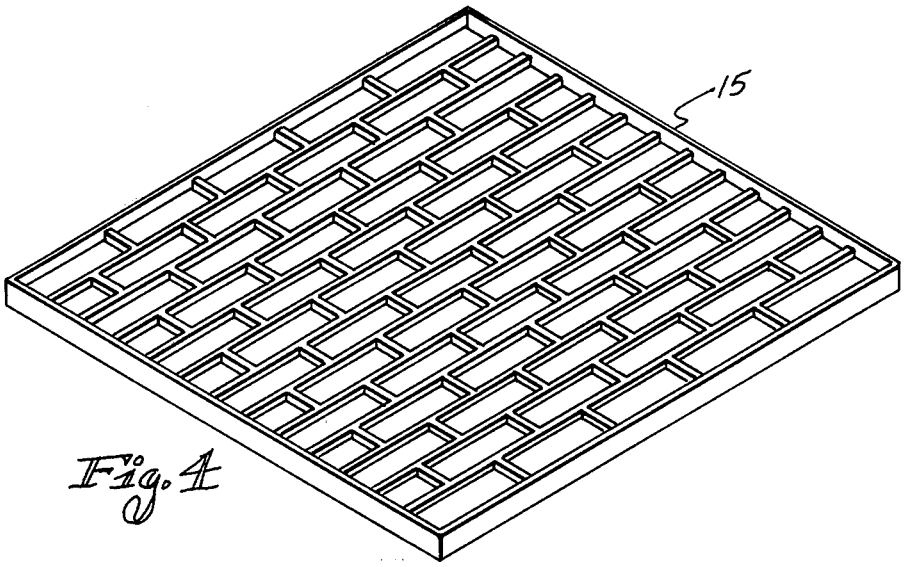
FIG. 4 is a perspective view of a mold mat.
Figure 3:
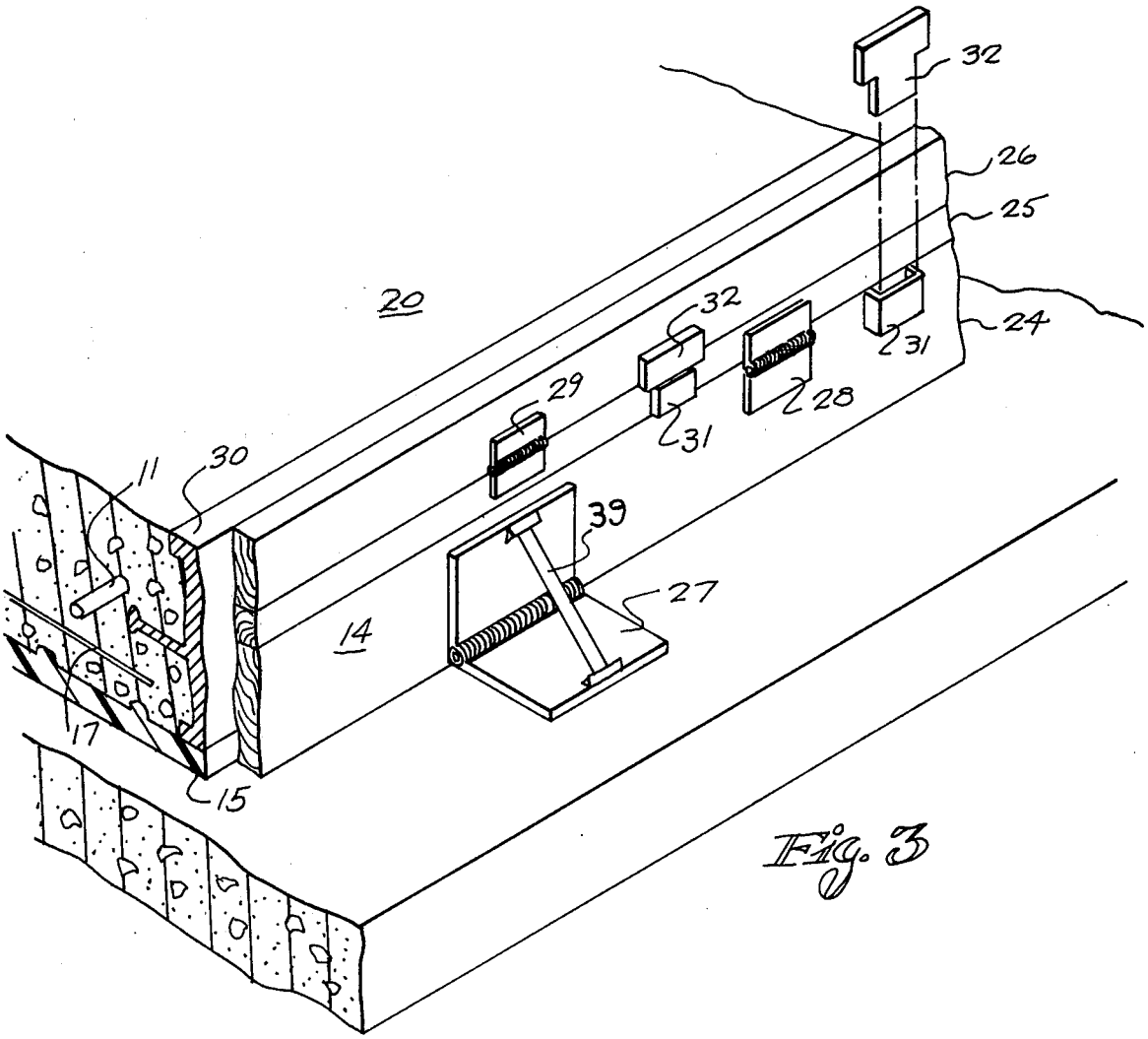
FIG. 3 is a partially sectioned perspective view illustrating in more detail one embodiment of form structure.

The specific arrangement of form 14 and the nature of panel 20 will be more readily appreciated with reference to detailed FIGS. 2, 3 and 4. Thus, it will be evident that casting table 10 is essentially a smooth, elongated slab of concrete or other such material.

Flexible mold 15 is contained within form 14 which molds or textures the lower or outer surface of panel 20 to a desired configuration. As shown in FIG. 4, flexible mold 15 is a tough, reusable, mat-like structure, preferably of a flexible material, such as, polyresin, neoprene or other elastomer which has defined on a surface thereon a negative design or configuration in order to produce an accurate and positive design or configuration on the surface, inner and/or outer, of panel 20. Although flexible mold 15 is illustrated in the form of a brick-like structure, it is to be understood that any number of designs could be utilized including that of stone construction, texturing in varying patterns, artistically oriented depressions, ridges or undercut patterns, etc. Preferably, mold 15 is about ⅜ inch thick and has a shore hardness of about A60.

One embodiment of forms 14 is comprised of several hinged modules or sections, as shown in FIG. 3, to facilitate stripping of form 14 from panel 20. Specifically, the walls of form 14 include a base module or section 24, an intermediate section or module 25 and an upper section or module 26. Hinge 27, of substantial rigidity and substance, secures base module 24 to casting table 10. Smaller hinges 28 and 29 attach intermediate module 25 to base module 24 and upper module 26 to intermediate module 25, respectively. Base module 24, intermediate module 25 and upper module 26 are locked into a planar configuration by means of securing member 31 attached to base module 24 and intermediate section 25, in conjunction with locking members 32 which are insertable into securing members 31. Base module 24 is locked into a perpendicular relationship to casting table 10 by means of strut 39 which is wedged between opposite ends of the hinge 27. The hinged modular forms also facilitate expeditious forming for selective depths of the shallow and deeper sections as well as accommodating use of a power screed to level and vibrate the cementitious material in the shallow section prior to forming and pouring the deeper section by selectively pivoting modules into vertical positions as form walls at appropriate times.

Figure 5:
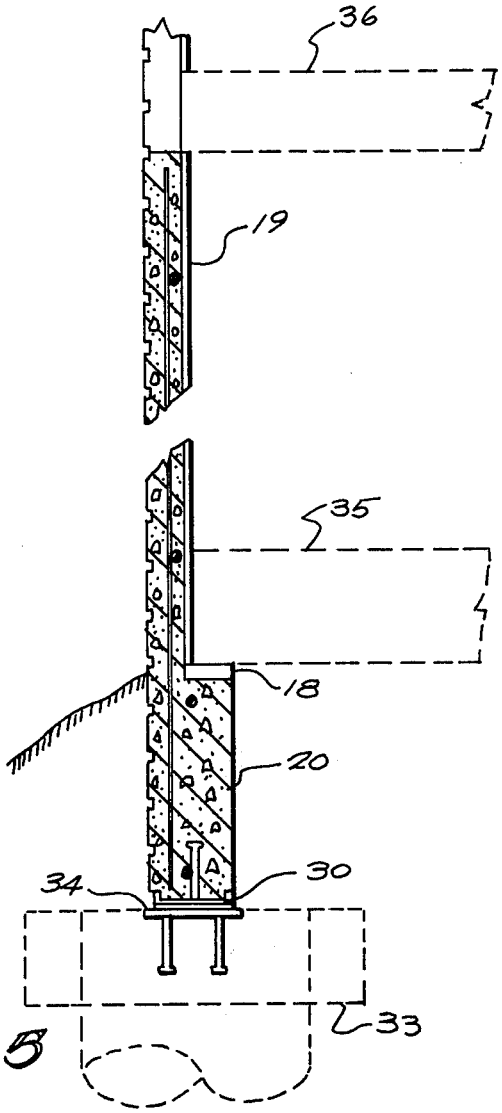

Also, as is more clearly observable in FIGS. 2 and 3, integral metal base plate 30 is positioned within form 14 prior to pouring of the cementitious material to form panel 20. Metal base plate 30 may be secured to conventional footing by means of bolts or other such conventional securing means, but is preferably welded to metal foundation plate 34 as shown in FIG. 5. Also shown in FIG. 5 is the manner in which integral header 18 receives, for instance, a floor joist 35 which is nailed into header 18 which is preferably of wood. Similarly, interior walls of panel 20 may be attached directly to furring strips 19 which are integral with panel 20 to facilitate quick, attractive and convenient finishing of the interior of the panel. Preferably, foam insulation is attached and then covered with the interior finish panel.

Figure 6:
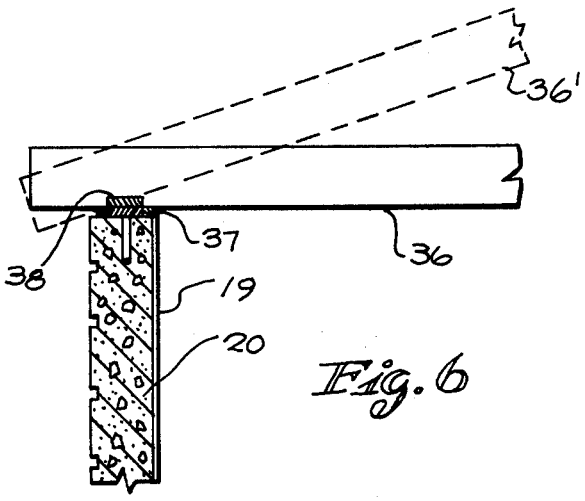
FIGS. 5, 6 and 7 are partial sectioned views illustrating the manner in which the panels are utilized to interface with one another and other construction materials.

Attachment of roof rafter 36 to panel 20 is shown in more detail in FIG. 6. Preferably, a metal rafter plate 38 is attached to roof rafter 36, which may be metal, concrete or wood, with rafter plate 38 being welded to upper metal plate 37 formed integrally with panel 20. This means is suitable both for horizontal roof rafter 36, or pitched roof rafter 36'.

Figure 7:
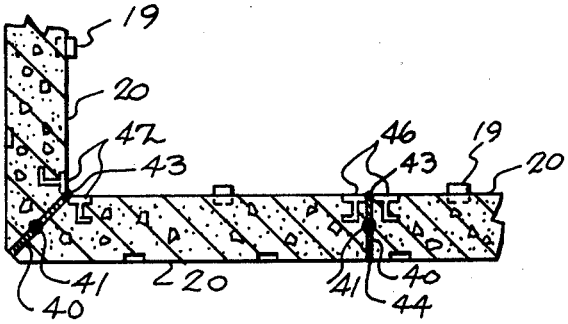

Particularly convenient and attractive means of joining panels 20 are illustrated in FIG. 7. Corner panels 20 are formed with a 45° angle at the ends thereof and with integral metal corners 42 formed in panels 20. Accordingly, panels 20 are positioned together with metal corners 42 abutting and a weld 43 is utilized to secure the two metal corners 42. Sealing beads 41, such as polyvinyl chloride cords of circular cross-sections, are also inserted to provide weather resistance. The remaining gap is then filled with sealant 40 and closed with an outer seal 44 to provide an attractive, convenient and weatherproof juncture between panels 20. A linear joint can be formed between panels 20 by means of inset metal tabs which are joined by weld 43 and similarly sealed with sealing band 41, sealant 40 and outer seal 44. Such specific means of joining panels 20 are included as being illustrative of the preferred arrangement according to panel or formed with the forming apparatus the instant invention, but, of course, other means of joining panels 20 will be apparent to those skilled in the art.

From the above description, several important advantages of the forming apparatus are apparent. For instance, by extending the number of cables or rods through a series of individual form portions between the adjustable form members placed on the casting table, efficiencies can be accomplished in forming the panels in a mass-production manner. Further, the positioning of the header intermediately of the form permits production of a panel having only the reduced quantities of material necessary to provide the desired function, i.e., the relatively thin wall section and the thicker beam section required to function as the foundation portion of the panel. The header not only serves as a portion of the form, but becomes an integral part of the panel to provide a nailable surface for receiving floor joists or other such construction material. The mold on the bottom allows the panels to be conveniently and cleanly taken from the casting bed with a pleasing finish, not obviously concrete.

A variation in the form of apparatus which can be used to construct the same concrete panels or a variety of other design panels is a significant improvement over the apparatus disclosed in the parent application and is now considered the preferred form of this invention.

Figure 8:
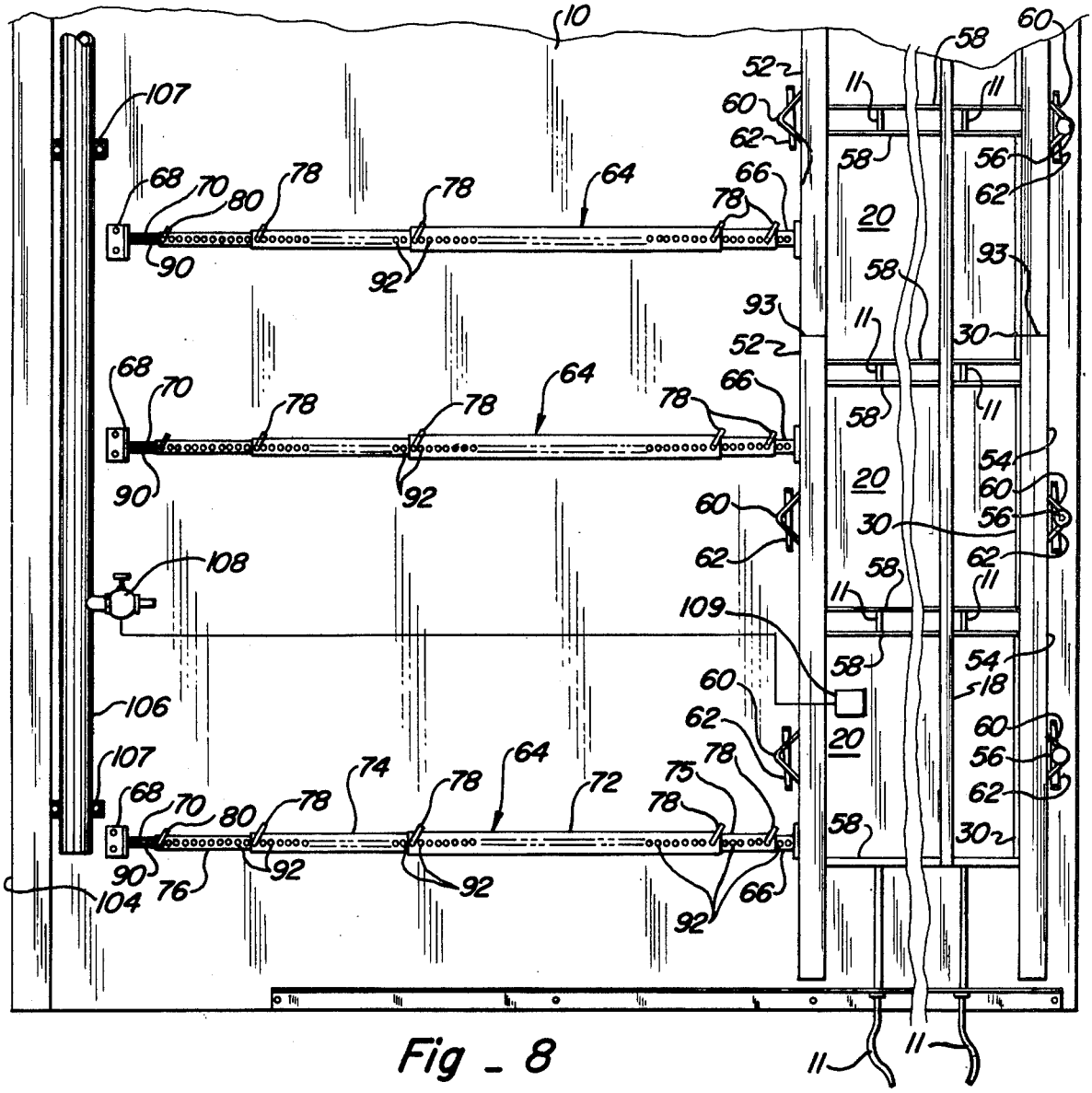
FIG. 8 is a plan view of the preferred form of the forming apparatus set up with a series of poured, prefabricated, prestressed concrete panels on the casting table.
Figure 9:
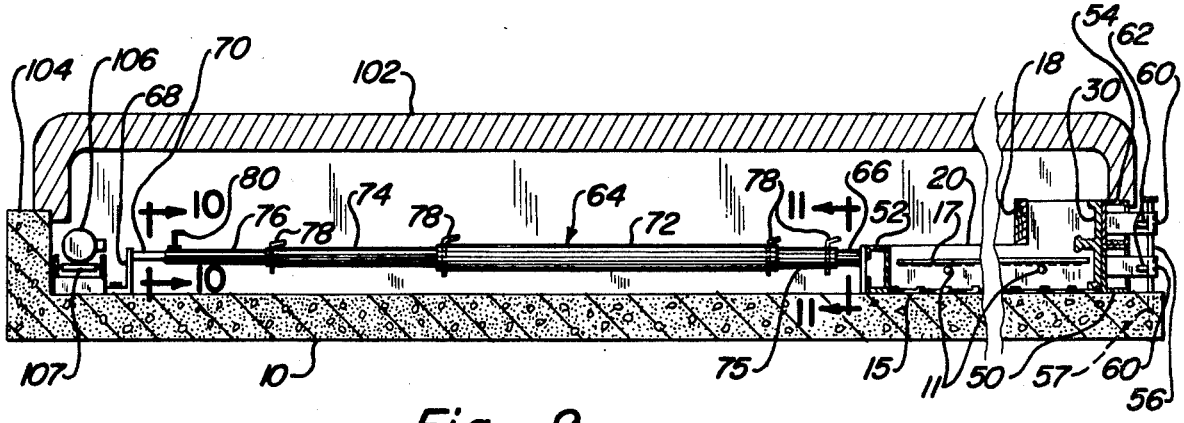
FIG. 9 is a transverse sectional view of the forms, panels, and casting table described in FIG. 8 with the addition of the insulated hood in position for curing the concrete.

As in the alternate form of invention, a casting table 10 is provided as a convenient, flat and permanent surface on which to form and pour a plurality of precast, prestressed and reinforced concrete panels. As best seen in FIGS. 8 and 9, the form apparatus includes a stationary form 50 which is secured in an immovable position by a plurality of anchor stakes 56 near the right sides of the casting table 10. A movable form 52 is also positioned on the surface of the casting table. This movable form 52 can be set at any desired position on the casting table 10 and is restrained against movement in the desired position by a plurality of adjustable braces 64. Extension forms 54 can also be positioned or stacked on top of either the stationary form 50 or the movable form 52 as required by any particular design specifications for the thickness of the concrete panels. FIG. 9 shows an extension form 54 stacked over the stationary form 50 to form the deeper base portion of the panel 20 as described in the parent application.

Side or bulkhead forms 58 constructed in a conventional manner are placed between the stationary form 50 and the movable form 52 as desired to form the sides of the panel 20. As shown in FIG. 8, a plurality of panels 20 can be formed side-by-side over the length of the surface of the casting table 10. Also depending on the design requirements for the panels, prestressing members 11, reinforcement members 17, flexible molds 15, metal base plates 30, and a header 18 can also be provided.

FIGS. 8 and 9 show the preferred form of concrete panel described in the parent application being formed with the forming apparatus which is the subject of the present invention. It can be appreciated, however, that the use of this form apparatus is not limited to forming only that panel. Even though not shown in FIGS. 8 and 9, it can also be appreciated that such other appurtenances as upper metal plates 37, metal rafter plates 38, metal corners 42, and furring strips 19 can be provided as desired.

The form sections 50, 52, and 54 are preferably defined by pressed metal members of channel-like cross-sectional configuration. Although the particular configuration of any form member can be varied, this particular configuration provides a relatively lightweight form member which is easy to handle yet has sufficient strength to resist bending or bowing of the forms between the brace members 64. Such characteristics are of course necessary to maintain a perfectly straight edge of the cast concrete panels; however, depending on the design requirements the forms could be curved, irregular, or of a different cross-section to provide grooves, channels, curves or any other configuration in the finished concrete panels that may be desired.

As described above, the stationary forms are set in place on the casting table and are held in immovable positions by stakes 56. Each stationary form member 50 has a plurality of anchoring appendages or sockets 60 protruding from its channel section on its external side. Each anchorage appendage 60 is in the form of a triangle and includes a securing wedge 62 which protrudes through the two external adjacent sides of the triangle and in spaced relation to the apex of the triangle. The anchoring stake 56 can be inserted through the anchoring appendage 60 between the securing wedge 62 and the apex of the anchoring appendage. The stake 56 is then inserted into an anchor hole 57 in the surface of the concrete casting table 10. The securing wedge 62 can then be driven into a binding relationship between the wedge slots 100 in the anchoring appendage 60 and the stake 56. When the wedge 62 is driven into this binding relationship, the stationary form 50 is retained in an immovable position on the surface of the casting table 10.

The movable form 52 is then set on the casting table 10 in parallel spaced relation to the stationary form 50 at a distance dictated by the particular design and desired finished height dimensions of the concrete panel to be formed. As best seen in FIGS. 8 and 9, the movable form can be retained at the desired position by horizontally extending adjustable braces 64. The adjustable braces 64 are comprised of a plurality of sections or spans of differing cross-sectional dimensions so that the smaller sized spans can be telescoped within the larger sized spans. Although any desired combination of spans can be used depending on the length and strength requirements, the preferred form shows a center span 72 which has the largest cross-sectional dimension. Telescoping into the left end of the center span 72 is an intermediate span 74 with a somewhat smaller cross-sectional dimension. Then telescoping within the end of the intermediate span 74 on the left side is an even smaller cross-sectional dimension end span 76. Also telescoping into the right side of center span 72 is another intermediate span 75. A brace mount 66 is attached to the movable form 52. This brace mount 66 is received within the right end of the right intermediate span 75.

Figure 11:
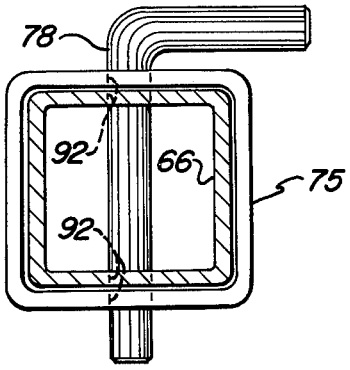
FIG. 11 is a cross-sectional view of the connection of the form braces to the brace mount of the form member taken along view line 11—11 in FIG. 9.

As best seen in FIG. 8, each of the spans is provided with a plurality of adjustment holes 92 in closely spaced relation to one another. As can be appreciated from FIGS. 8, 9 and 11, the telescoping spans with their plurality of holes 92 can be set to the desired position with holes in each span aligned, and retainer pins 78 can be inserted through the aligned holes to retain the adjustable braces in position. FIG. 11 shows the smaller cross-sectional dimension brace mount 66 inserted into the larger cross-sectional dimension right intermediate span 75 with holes 92 aligned and retainer pins 78 inserted through the holes. It can also be appreciated that brace members constructed of flat span sections slidably adjustable along one another rather than tubular telescopic span sections could be used to accomplish the bracing function in substantially the same manner, but the tubular telescopic span provide better structural rigidity and are easier to manipulate.

Even though the holes 92 in adjustable braces 74 are closely spaced, a particular panel design requirement is that the distance between the adjusting holes 92 in the brace 64 be split. A fine adjusting mount 70 is provided on the left end of the brace 64 for just this purpose. After the movable form 52 is crudely placed in position and braced by setting the telescoping span and retainer pins, the movable form 52 can be moved into the precise position required by the design dimension of the panel to be formed. The fine adjusting mount 70 at the left end of the span 76 can accommodate small variations in movement of the brace 64, and when the precise position of movable form 52 is obtained, the brace 64 can be set to retain the form 52 in precisely that position by tightening the fine adjustment screw 80.

Figure 10:
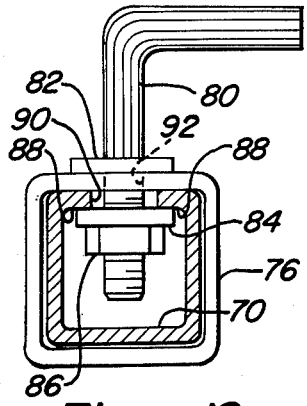
FIG. 10 is a cross-sectional view of the precision adjusting mechanism in the form braces taken along view line 10—10 in FIG. 9.

The fine adjusting mount 70 is affixed to an end abutment 68 which is secured to the surface of the casting table 10. As best seen in FIGS. 8, 9 and 10 the fine adjusting mount 70 has a substantially rectangular cross-sectional configuration with a channel opening 90 in its top surface formed by return lips 88. The end span 76 of the adjustable brace 64 is inserted over the fine adjusting mount 70. A threaded fine adjustment screw 80 is inserted into an adjustment hole 92 in the end span 76. When the fine adjusting mount 70 is received into the end of the end span 76, the fine adjustment screw 80 extends down through the channel opening 90 in the fine adjusting mount 70. A collar 82 is immovably affixed around the shaft of the fine adjustment screw 80. A nut 86 with a square collar 84 immovably attached to the nut is screwed onto the end of the fine adjustment screw 80. Consequently, when the fine adjustment screw 80 is turned the nut 86 and square collar 84 are drawn into tight abutting contact with the return lips 88 of the fine adjusting mount 70, and the collar 82 is forced into snug-fitting relationship with the outer surface of the end span 76. It can be appreciated that by turning the fine adjustment screw 80 the return lips 88 of fine adjusting mount 70 are forced into a tight binding frictional contact with the inside surface of the end span 76. With sufficient tightening, the fine adjusting mount 70 and the end span 76 can be retained from lateral movement in relation to one another. In this manner, the movable form 52 can be set and retained by the adjustable brace 64 at any precise position desired. The collar 84 is squared and immovably affixed to nut 86 so that the square corners of collar 84 can come in contact with the inside surface of the side walls of fine adjusting mount 70 to resist the tendency of the nut to turn along with the turning of the fine adjustment screw 80. Thus no wrench or other retaining tool is required to prevent the nut 86 from turning while the fine adjustment screw 80 is being turned to draw the fine adjusting mount 70 and the end span 76 into tight abutting relationship with one another.

Figure 12:
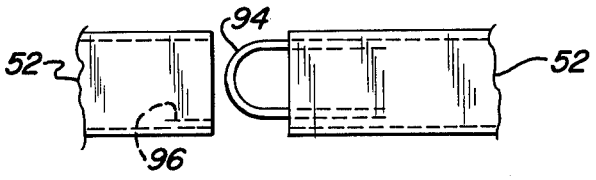
FIG. 12 shows a plan view of the respective ends to form members just prior to being secured together in a lengthwise manner.
Figure 14:
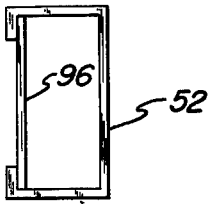
FIG. 14 is an end view of the female guide end of the form member as seen along section line 14—14 in FIG. 13.
Figure 13:
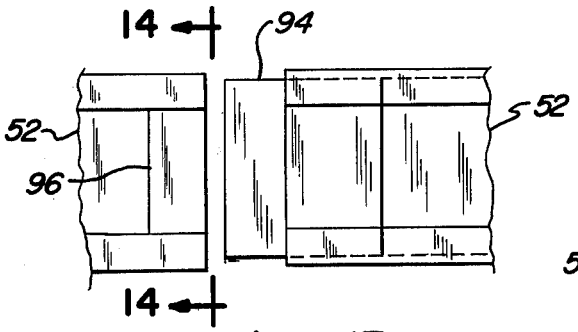
FIG. 13 is a side view of the same section of the form members as shown in FIG. 12.

Each of the forms 50, 52 and 54 is of the same configuration and is divided into sections of convenient length and weight for ease in handling and adaptability to various panel prefabrication requirements. As can be seen in FIGS. 8, 12 and 13 the ends of the panel sections fit together to form a tight and immovable joint 93. As best seen in FIGS. 12 and 13, one end of each form section includes a male insert 94, and the opposite end of each form section includes a female guide 96. The insert 94 is received in the end of the adjacent form section 52 in close-fitting relationship with the guide 96 therein. When the insert 94 is slid its entire length into the end of the adjacent form section 52, a tight joint 93 results in a continuous length of form 52 for any desired total length along the surface of the casting table 10. As mentioned above, even though this joint arrangement has been described by reference to the movable form 52, the same insert 94, guide 96, and joint 93 are provided on the other forms such as the stationary form 50 and the extension form 54.

Figure 15:
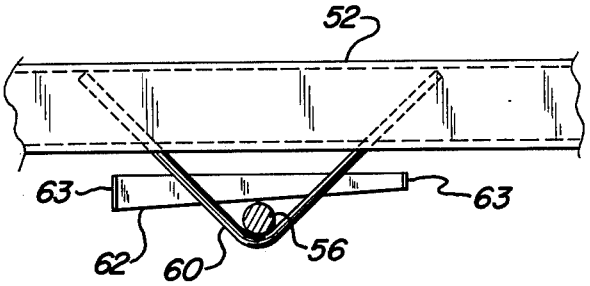
FIG. 15 is a plan view of a portion of a form member showing the stake-receiving appendage with a stake wedged into position.
Figure 16:
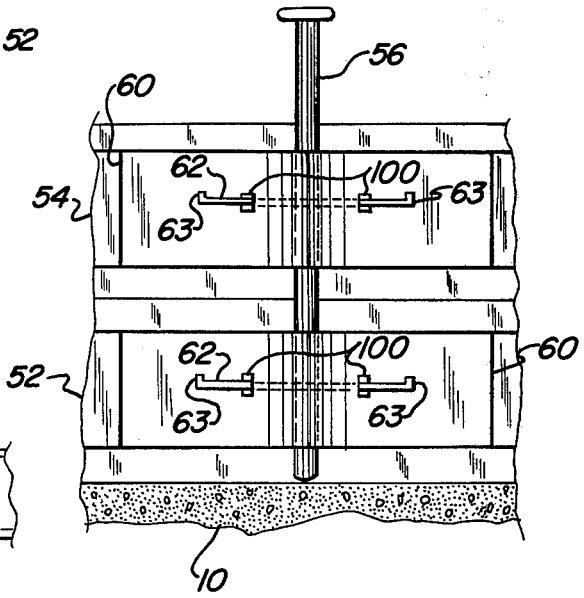
FIG. 16 is a side view of a portion of two form members one stacked on top of the other and showing the form members being secured together by the anchor stake.

The apparatus and method for securing the stationary form 50 in immovable position on the surface of the casting table 10 by use of the anchoring appendage 60, anchor stake 56, and securing wedge 62 was described above. As can be seen in FIGS. 9, 15, and 16 these same parts are used to secure the extension forms 54 on top of either the stationary form 50 or the movable form 52. The devices and procedures are the same for securing the extension form 54 on top of either the stationary form 50 or the movable form 52 with the exception that when the extension form 54 is secured on top of the movable form 52, the stake 56 is not inserted the entire distance down into a hole 57 in the casting table 10 as shown in FIG. 9. Instead, as best seen in FIG. 16, when extension form 54 is placed on top of movable form 52 with the respective anchoring appendages 60 positioned in an over-and-under relationship to one another, the stake 56 is inserted through each anchoring appendage 60 in the space between the securing wedge 62 and the apex of the anchoring appendage. The bottom of stake 56 simply rests on the surface of casting table 10. The securing wedge 62 is then driven with a hammer into a wedging relationship between the slots 100 in the anchoring appendages 60 and the stake 56. The wedge 62 can be driven into this wedging relationship with a hammer. Lips 63 are provided on the ends of wedge 62 both to prevent the wedge from sliding through the slots 100 and becoming lost when not in use and also to provide a hammering surface on the wedge 62. Obviously, when the wedges in both the extension form 54 and the movable form 52 are driven into the wedging position against stake 56, forms 54 and 52 will be retained in an immovable superimposed or stacked relationship with one another. Obviously, the forms are restrained from lateral movement by the adjustable braces 64 as described above.

Finally, as best seen in FIGS. 8 and 9, after the forms have been set as described above and the desired concrete panel poured, screeded and troweled with the desired appurtenances inserted, an insulated hood 102 is positioned over the entire casting table, one side of the hood resting on the top of the bulwark 104 of casting table 10 and the opposite side resting on top of the extension form 54. With the insulated hood 102 in place, steam for curing can be introduced over the poured concrete through steam pipe 106 and valves 108. Steam pipe 106 is supported by a roller support 107 to accommodate expansion and contraction of the steam pipe 106. Also, if desired, the temperature and amount of steam desired can be controlled over any portion of the casting table by the use of heat sensors 109 strategically located along the casting table near the poured concrete, which sensors 109 are connected to automatic valves 108 in the steam line. As the temperature increases or decreases the automatic valves 108 in the steam line will be automatically opened or closed as required to maintain a constant temperature under the hood at any location on the casting table.

The flexible mold mat 15 can be fabricated with any desired surface pattern such as brick, stone, or old barn wood. This procedure is accomplished by simply fabricating a small area of the real building material, as brick, stone, or barn wood, on a horizontal surface. The width of the area should be sufficient to cover the height dimension of the panel to be formed, and the length dimension can be any convenient dimension. A hot, molten polymer material is then poured on the prepared area of brick, stone, barn wood, or other desired material and allowed to cool. As the polymer material cools, it sets with a negative image of the pattern of the prepared area of building material. When the polymer is sufficiently cooled and set to hold the pattern, it is moved off the area of building material, but leaving one edge in contact with the building material. A second pour of hot, molten polymer is then made on the building material in the same way and allowed to flow into contact with the edge of the set polymer from the first pour, thus joining the two portions of polymer mold mat 15 as the second pour cools and sets. As this procedure is repeated in subsequent steps, it can be appreciated that a flexible mold mat 15 of any desired length with a repeating negative pattern of the desired building material can be fabricated. The overall length of the mold mat 15 can be sufficient to accommodate one or a series of adjacent panel forms on the casting table.

Since the combination melting pot with the required heating elements and stirring mechanism is quite large, heavy, and cumbersome to move, it has been found to be more convenient to keep the pot and pouring spout in stationary position. The table surface on which the real building material is fabricated is mounted on a movable track so that the building material can be moved to accommodate a uniform pour of polymer from the spout over the entire area of building material. Then when a pour of polymer is cooled and set, the polymer can simply be lifted from the building material, the table moved back to starting position, and subsequent pours can be made in the same manner.

After a particular concrete panel job is completed, the flexible molds 15 can be reused, or they can be cut up and remelted for use in fabricating new mold mats with different patterns.

Although the present invention has been described with a certain degree of particularity, it is understood that the present disclosure has been made by way of example and that changes in details and structure may be made without departing from the spirit thereof.

I claim:

1. A set of elements for use in simultaneously producing a series of prestressed and reinforced cementitious building panels of substantially rectangular shape with a shallower wall portion and a deeper foundation portion on a casting table, comprising:

a plurality of box-like forming means adapted to be placed in spaced relation to one another on the casting table each box-like forming means including a first form member for the bottom of the panel, a second form member in parallel, spaced relation to said first form member for the top of the panel, and parallel, spaced bulkhead forms for the sides of the panel, said first form member being adapted to be immovably secured to said casting table and being comprised of a plurality of modules removably stacked one on top of another in a plane to form said deeper foundation portion;

stacking means on the outside surface of said first form member in spaced relation from the ends of said first form member for maintaining said modules in stacked relation, said stacking means including a socket permanently affixed on said side of each of said modules in positions such that a socket on each module is in vertical alignment with a socket on a module vertically adjacent thereto, and a stake adapted for insertion through said vertically aligned sockets; and hinge means on said modules for pivotally connecting said modules one to another, and in which said stacking means are provided on each of said modules whereby the lower of said modules can be selectively stacked while the upper of said modules remain unstacked.

2. The set of elements of claim 1 including a flexible mold mat having a patterned surface adapted to be placed within said forming means on the surface of said casting table with said patterned surface facing upward for forming a patterned surface in said panels.

3. An apparatus for simultaneously casting and curing a plurality of cementitious panels comprising:

a casting table including a flat upper surface;

a plurality of spaced-apart, elongated form members on said flat upper surface, one of said form members being immovably secured to said casting table and another of said form members being movably secured to said casting table;

elongated axially adjustable bracing means for adjustably restraining said movable form member from lateral movement in relation to said immovable form member, one end of which is permanently secured to said casting table and the opposite end of which is attached to said movable form member, said bracing means including a multiplicity of tubular spans telescopically assembled together, and releasable locking means for locking said bracing means in any of a desired number of incremental axially adjusted lengths, and including fine adjustment means on said one end of said bracing means for adjusting the axial length of said bracing means to any desired length intermediate of those increments obtained by securing said locking means;

stacking means on the outside of each of said form members for detachably securing additional form members in stacked position on top of said form members on the casting table;

a plurality of spaced-apart side form members for forming the sides of a plurality of panels within said one immovable form member and said other movable form member, each of said side form members having one end in contact with said one immovable form member and the opposite end in contact with said other movable form member and having holes therein to accommodate the passage of prestressing cable through said side form members;

an elongated flexible form mat on the surface of said casting table between said elongated form members;

steam delivery means for introducing steam over said casting table and form members, roller support means on said casting table supporting said steam delivery means above said casting table while allowing for expansive movement of said delivery means, and heat sensitive detectors and valve means on said steam delivery means for varying the quantity of steam emitted from said delivery means; and an insulated cover member placed over said casting table and form members for retaining steam over said casting table to aid in curing cementitious material poured into said form members.

4. A set of elements for use in simultaneously forming opposite ends of a plurality of cementitious panels on the flat top surface of a casting table, comprising:

a first elongated form member adapted to be disposed on the flat top surface of the casting table releasably secured thereon in an immovable manner;

a second elongated form member adapted to be disposed on the flat top surface of the casting table in parallel, laterally adjustable spaced-apart relation to said first form member;

laterally adjustable bracing means adapted to be disposed horizontally over the top surface of the casting table on the side of said second form member opposite said first form member for restraining said second form member from lateral movement in any desired laterally spaced position from said first form member in a range on the casting table, said bracing means including an elongated axially expandable and contractable brace strut comprised of a multiplicity of elongated tubular spans telescopically assembled together with adjustable locking means in each of said spans for releasably locking adjacent spans in immovable relation to each other, one end of said brace strut being attached to the outside of said second form member, and the opposite end of said strut brace having a split sleeve, one end of which is axially and slidably received within said opposite end of said brace strut and the opposite end of which is immovably attached to said casting table, and a fine adjustment screw which tightens and releasably locks said split sleeve at any of an infinite number of positions within said opposite ends of said brace strut.

* * * * *